US005813329A

United States Patent [19]

Tateishi et al.

[11] Patent Number: 5,813,329

[45] Date of Patent: Sep. 29, 1998

[54] PRINTER FOR WRAPPING STENCIL AROUND DRUM

[75] Inventors: Hiroshi Tateishi, Fujinomiya; Fumiaki Arai; Tetsuo Tanaka, both of Mishima, all of Japan

[73] Assignees: Ricoh Company, Ltd., Tokyo; Tohoku Ricoh Co., Ltd., Miyagi-ken, both of Japan

[21] Appl. No.: 469,764

[22] Filed: Jun. 6, 1995

Related U.S. Application Data

[63] Continuation of Ser. No. 174,334, Dec. 28, 1993, abandoned.

[30] Foreign Application Priority Data

Dec. 29, 1992 [JP] Japan ..... 4-361163
Dec. 29, 1992 [JP] Japan ..... 4-361164

[51] Int. Cl.[6] ..... B41L 13/04; B41L 13/14

[52] U.S. Cl. ..... 101/116; 101/128.1; 101/128.4

[58] Field of Search ..... 101/114, 116–119, 101/127, 128, 128.1, 128.21, 128.4, 129, 477; 355/213

[56] References Cited

U.S. PATENT DOCUMENTS

| | | | |
|---|---|---|---|
| 3,491,684 | 1/1970 | Borinsky | 101/132 |
| 3,826,570 | 7/1974 | Kolibas | 101/132 |
| 5,048,416 | 9/1991 | Iijima | 101/115 |
| 5,140,989 | 8/1992 | Igarashi | 101/120 |
| 5,355,795 | 10/1994 | Moss et al. | 355/213 |
| 5,513,564 | 5/1996 | Sato | 101/116 |
| 5,535,671 | 7/1996 | Kanno | 101/116 |

FOREIGN PATENT DOCUMENTS

| | | | |
|---|---|---|---|
| 11284 | 1/1986 | Japan | 101/114 |
| 287781 | 12/1986 | Japan | 101/116 |
| 73987 | 4/1987 | Japan | 101/114 |
| 73988 | 4/1987 | Japan | 101/116 |

*Primary Examiner*—Stephen R. Funk
*Attorney, Agent, or Firm*—Oblon, Spivak, McClelland, Maier & Neustadt, P.C.

[57] ABSTRACT

In a printer using a stencil, a drum and a stencil feed and discharge unit are constructed integrally with each other. Hence, a stencil can be fed, cut by a thermal head, wrapped around the drum, and then discharged without being cut off. Even a stencil substantially implemented by a thermoplastic resin film, which is thin and soft, can be transported without being creased or otherwise deformed.

15 Claims, 8 Drawing Sheets

PRINTER FOR WRAPPING STENCIL AROUND DRUM

This application is a Continuation of application Ser. No. 08/174,334, filed on Dec. 28, 1993, now abandoned.

BACKGROUND OF THE INVENTION

The present invention relates to a printer using a stencil, the printer having a drum and a stencil feed, a discharge unit constructed integrally with the printer, and a method of wrapping a stencil around the drum.

A printer of the type described, (particularly a printer capable of cutting a stencil with a thermal head, wrapping it around a drum, printing, and discharging the stencil automatically) is easy to operate and extensively used in various facilities, e.g., offices and schools for producing various kinds of printings. In this type of printer, a master making a stencil section cuts a stencil paid out from a stencil feeding section by heat. After the cut portion of the stencil has been brought to a drum by a transport mechanism, a cutter mechanism cuts it off to produce a master sheet. The master sheet is wrapped around the peripheral wall of the drum. As paper is fed to a printing section, an image is printed thereon via the master sheet. Thereafter, the master sheet is collected in a discharging section.

The problem with the conventional printer described above is that the transport mechanism for implementing such a procedure is complicated and apt to cause defective transport and other troubles to occur. Moreover, a mechanism for wrapping the master sheet around the wall of the drum and clamping it thereon is needed, increasing the overall size of the printer.

To eliminate the above problems, Japanese Patent Laid-Open Publication No. 62-73987 proposes a printer in which a stencil feeding section, a stencil discharging section and a master making section are located around the peripheral wall of a drum. This printer cuts a stencil with a thermal head, wraps it around the drum, prints, and then discharges the used stencil without cutting it off. Specifically, the printer has a stencil feed and discharge unit adjoining and rotatable relative to the peripheral wall of a drum. The feed and discharge unit is made up of a feed section for paying out a stencil from a roll, a platen roller, a thermal head, and a discharge or take-up section for taking up the stencil or master used. However, this kind of implementation brings about another problem that even the head of the master making section is combined with the drum, increasing the weight of the master making section. This is likely to prevent the drum from rotating smoothly. Also, the wiring for sending signals to the head is complicated. In addition, paper dust and other impurities are apt to deposit on the head to thereby prevent it from cutting the stencil accurately.

A traditional stencil is made up of a porous substrate and a polyester or similar thermoplastic resin film adhered t o the substrate and, therefore, has substantial thickness. There has recently been proposed a printer operable with a stencil having a porous substrate which is as thin as about 3 $\mu$m to 10 $\mu$m or a stencil substantially constituted only by a thermoplastic resin film (6 $\mu$m to 13 $\mu$m thick), as taught in, for example, Japanese Patent Laid-Open Publication Nos. 3-240596, 4-7198, and 3-99890. However, since such a film having an extremely thin substrate or lacking a substrate is short of mechanical strength, it tears easily unless handled with care. Moreover, this kind of film is extremely soft and apt to cause defective transport to occur (jam, wrapping around a conveyor roller, etc.)

SUMMARY OF THE INVENTION

It is, therefore, an object of the present invention to provide a printer capable of cutting a stencil with a thermal head, wrapping it around a drum, printing and discharging the stencil without cutting it off, and a method of wrapping the stencil around the drum.

It is another object of the present invention to provide a printer operable even with a stencil implemented by a thermoplastic resin film, which is as thin as 0.5 $\mu$m to 20 $\mu$m and has only an extremely thin substrate or even lacks a substrate, and capable of surely transporting it to and wrapping it around a drum.

It is another object of the present invention to provide a printer which allows a drum thereof to rotate in a well balanced condition, and simplifies a wiring for sending a signal to a thermal head.

A printer using a stencil of the present invention has a drum having a portion permeable to ink in a part of the peripheral wall thereof and allowing a cut portion of the stencil to be wrapped therearound, an ink supply section disposed in the drum, and a stencil feed and discharge unit adjoining the outer periphery of the peripheral wall of the drum, located inside of the rotation system of the drum, and rotatable relative to the peripheral wall of the drum. The stencil feed and discharge unit has at least a feed section accommodating the stencil in the form of a roll, a discharge section for taking up and accommodating the used stencil, and a platen roller for cutting the stencil. A cutting section is located outside of the rotation system of the drum for pressing, in the event of making a master, against the platen roller to thereby cut the stencil by heat. The cutting section and platen roller are movable relative to each other in the event of making a master.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 13:
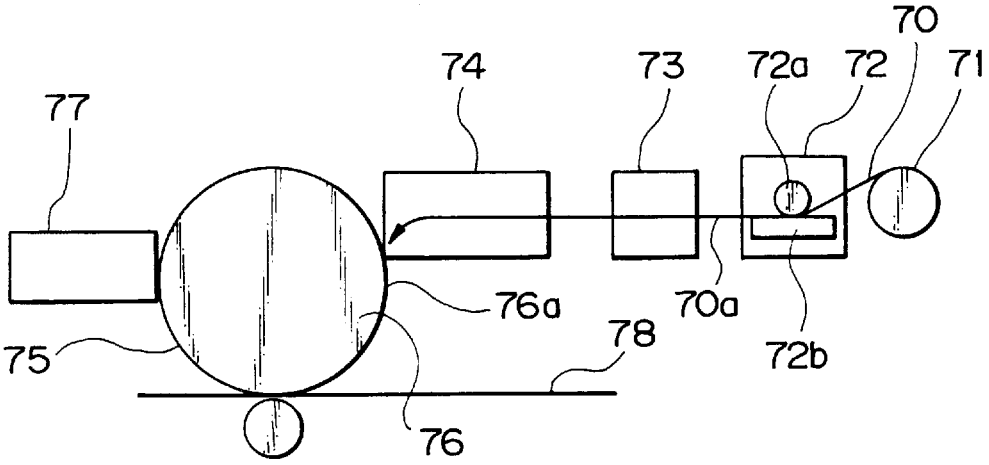
Fig. 13 PRIOR ART
FIG. 13 shows the general construction of a conventional printer having a master making section and a printing section constructed integrally with each other.

To better understand the present invention, a brief reference will be made to a conventional printer having a master making section and a printing section constructed integrally with each other. As shown in FIG. 13, a stencil 70 in the form of a roll is paid out from a stencil feeding section 71. A master making section 72 has a platen roller 72*a* and a thermal head 72*b*. A cutter mechanism 73 cuts off a part of the stencil 70 which has been cut by the head 72*b*, thereby producing a master sheet 70*a*. A transport mechanism 74 transports the master sheet 70*a* to a printing section 75. There are also shown in the figure a drum 76 having a peripheral wall 76*a*, a master discharging section 77, and a paper 78. In operation, the master making section 72 cuts the stencil 70 paid out from the stencil feeding section 71 by heat. After the cut portion of the stencil 70 has been brought to the drum 76 by the transport mechanism 74, the cutter mechanism 73 cuts it off to produce the master sheet 70*a*. The master sheet 70*a* is wrapped around the peripheral wall 76*a* of the drum 76. As the paper 78 is fed to the printing section 75, an image is printed thereon via the master sheet 70*a*. Thereafter, the master sheet 70*a* is collected in the discharging section 77.

As stated above, the conventional printer cuts the stencil 70 at the master making section 72, conveys it to the printing section 75, and then cuts it off with the cutter mechanism 73 to produce the master sheet 70*a*. The transport mechanism 74 for implementing such a procedure is complicated and apt to cause defective transport and other troubles to occur. Moreover, a mechanism for wrapping the master sheet 70*a* around the wall 76*a* of the drum 76 and clamping it thereon is needed, increasing the overall size of the printer.

Figure 14:
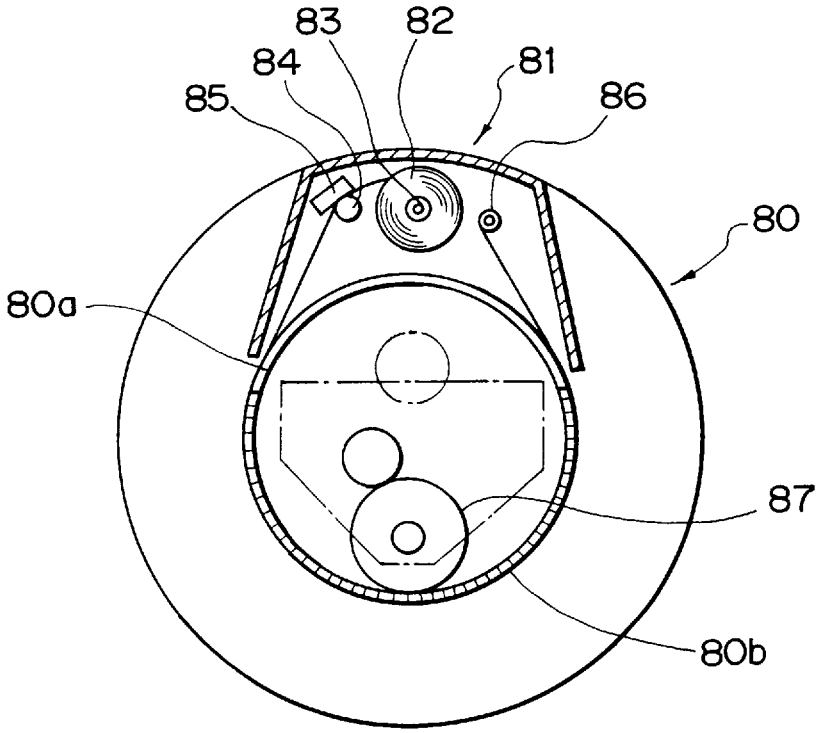
Fig. 14 PRIOR ART
FIG. 14 is a fragmentary sectional side elevation of the conventional printer.

FIG. 14 shows a printer taught in Japanese Patent Laid-Open Publication No. 62-73987 and elaborated to eliminate the above-discussed problems. Briefly, this printer locates a stencil feeding section, stencil discharging section and master making section around the peripheral wall of a drum, and cuts a stencil, wraps it around the drum, prints, and then discharges the used stencil without cutting it off. Specifically, as shown in FIG. 14, the printer has a feed and discharge unit 81 adjoining the peripheral wall 80*a* of a drum 80 and rotatable relative to the wall 80*a*. The feed and discharge unit 81 is made up of a feed section 83 for paying out a stencil 82 from a roll, a platen roller 84, a thermal head 85, and a discharge or take-up section 86 for taking up the stencil or master used. A part 80*b* of the drum wall 80*a* is permeable to ink. Ink supplied from ink supplying means 87 is fed to a paper, not shown, via the permeable part 80*b* of the drum wall 80*a*. However, this kind of implementation brings about another problem that even the head 85 of the master making section is combined with the drum 80, increasing the weight of the master making section. This is likely to prevent the drum 80 from rotating smoothly. Also, the wiring for sending signals to the head 85 is complicated. In addition, paper dust and other impurities are apt to deposit on the head 85 to thereby prevent it from cutting the stencil 82 accurately.

The present invention is free from the drawbacks stated above and will be described hereinafter. Briefly, in accordance with the present invention, a roll of stencil is received in a cassette. Only if the cassette is mounted to a printer, the stencil or webbing can be cut and then wrapped around a drum in a desirable manner. Therefore, the problems described previously do not arise so long as the cassette is set in a correct position.

Figure 1A:
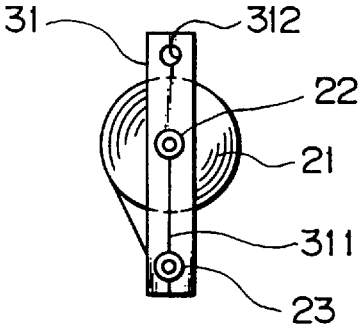
FIGS. 1A and 1B are respectively a front view and a side elevation showing a specific configuration of a cassette applicable to the present invention and accommodating a roll of stencil therein.
Figure 1B:
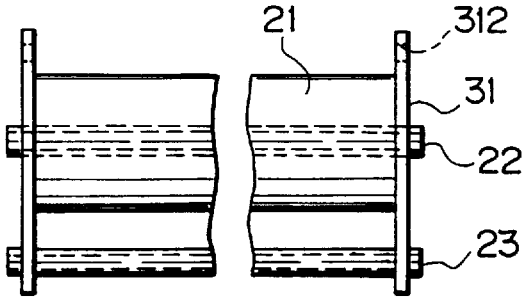

FIGS. 1A and 1B show a specific configuration of such a cassette. As shown, the cassette has a feed shaft or roll shaft 22 around which a stencil 21 is wound in the form of a roll. The edge of the stencil 21 paid out from the roll is wound around another shaft or take-up shaft 23 located close to the feed shaft 22. The shafts 22 and 23 are affixed to a support member 31 through holes. A slit 311 is formed through the support member 31 and extends from the feed shaft 22 to the end of the member 31 via the take-up shaft 23. A hole 312 is formed through the support member 31. After the cassette has been mounted to the printer, the hole 312 is used to remove the support member 31.

Figure 2A:
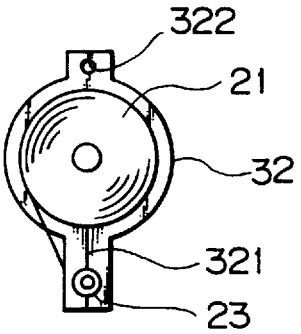
FIGS. 2A and 2B are respectively a front view and a side elevation showing another specific configuration of the cassette.
Figure 2B:
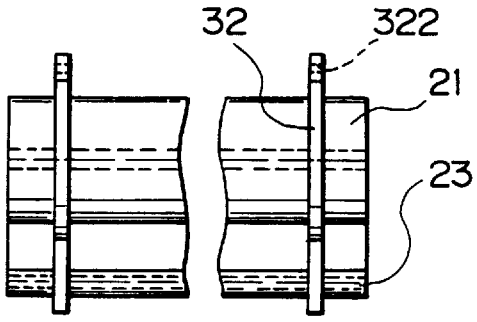

FIGS. 2A and 2B show another specific configuration of the cassette. This configuration differs from the configuration of FIGS. 1A and 1B in that the feed shaft 22 is absent, in that the stencil 21 is rolled up in such a manner as to form a cylindrical through bore at the center thereof, and in that the outer periphery of the roll 21 and take-up shaft 23 are held by a support member 32. The reference numeral 322 designate a hole formed through the support member 32.

Figure 3A:
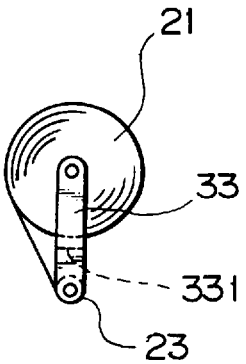
FIGS. 3A and 3B are respectively a front view and a side elevation showing still another specific configuration of the cassette.
Figure 3B:
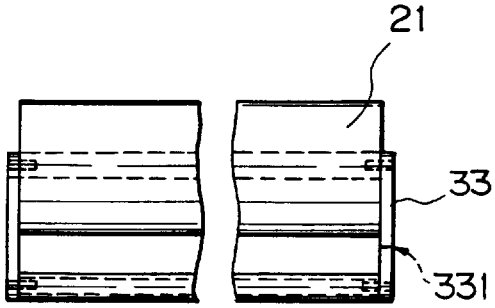

FIGS. 3A and 3B show still another specific configuration of the cassette. As shown, the cassette has a support member 33 which is simpler than the support members shown in FIGS. 1A and 1B and 2A and 2B. Perforations 331 are formed through the support member 33 in the horizontal direction.

The cassettes shown in FIGS. 1A and 1B and FIGS. 2A and 2B are each mounted to a printer with the feed shaft (feed section) 22 supported by a shaft, which is not related to the rotation of a drum, and with the take-up shaft (discharge section) 23 supported by a shaft movable in interlocked relation to the rotation of the drum. Thereafter, the support member 31, 32 or 33 is removed. Specifically, the support member 31 or 32 can be removed only if a finger is put in the hole 312 or 322 and moved forward to pull the member 31 or 32. Also, the support member 33 can be removed only if it is torn off along the perforations 331.

Figure 4A:
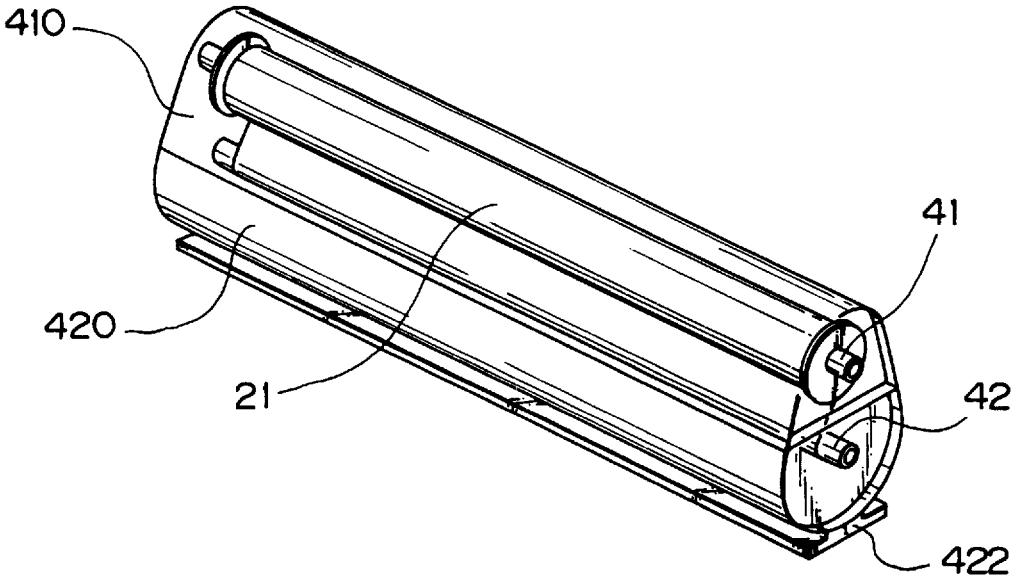
FIGS. 4A and 4B are respectively a perspective view and a side elevation showing a further specific configuration o f the cassette.
Figure 4B:
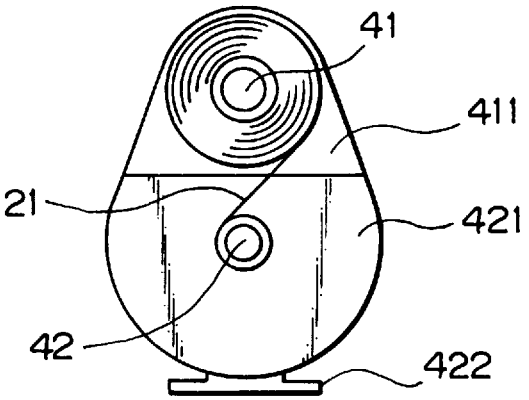

FIGS. 4A and 4B show a further specific configuration of the cassette. As shown, the cassette has a feed shaft 41 and a take-up shaft 42 which are separated from each other by two separable support members or casing parts 410 and 420. However, in the longitudinal direction, the casing parts 410 and 420 contact each other only along the peripheral edges thereof to allow the stencil 21 to extend therethrough. The casing parts 410 and 420 have end walls 411 and 421, respectively. The feed shaft 41 and take-up shaft 42 are rotatable and slightly protrude respectively from the side walls 411 and 421 of the casing parts 410 and 420 at opposite ends thereof. The reference numeral 422 designates an engaging member which will be described.

In any one of the four specific cassette configurations, the edge of the stencil 21 paid out from the roll may be attached to the take-up shaft 23 or 42 by any conventional scheme, e.g., a two-sided adhesive tape, adhesive, a slit formed in the shaft 23 or 42, or magnetism. The stencil 21 may be attached to the feed shaft 22 or 41 in the same manner as it is attached to the take-up shaft 23 or 42. However, in the case where the webbing 21 should be fully taken up by the shaft 23 or 42 up to the end of the roll, it is preferable not to fix the end of the webbing 21 to the shaft 22 or 41. In this case, use may advantageously be made of a weak paste (easily separable paste). The feed shaft is not essential, as shown in FIGS. 2A and 2B and 3A and 3B.

Since the feed section and discharge or take-up section associated with the stencil 21 are connected together by the support member 31, 32 or 33 or the casing parts 410 and 420, a person can set the feed shaft and take-up shaft on a printer at the same time. Regarding the cassette of FIGS. 1A and 1B, 2A and 2B or 3A and 3B, the support member thereof is removed after the two shafts have been set on a printer. This reduces the moment of inertia of a drum included in the printer and, therefore, causes a minimum of load to act on the rotation system of the printer. In the case of the cassette shown in FIGS. 4A and 4B, it is only necessary that the casing parts 410 and 420 be separable after the cassette has been mounted to the printer. This is the prerequisite for the webbing 21 to be wrapped around the drum.

The present invention is practicable with any conventional ink supply means having an ink reservoir, pump, ink supply tube, squeegee roller or blade, doctor roller, etc. The functions included in the ink supply means may be distributed to a plurality of locations and may be located on side walls associated with a drum, the inside of the drum, and even at locations other than the location adjoining the drum.

The peripheral wall of the drum may be implemented by a mesh of metal or chemical filaments with or without plating and may be configured in any conventional manner.

In accordance with the present invention, the support member described above is advantageous for an extremely thin stencil to be set on a printer and cut. Particularly, the advantage is prominent when use is made of a stencil implemented by a substantially thermoplastic resin film lacking a substrate. A stencil constituted only by a thermoplastic resin film will be described hereinafter.

The thermoplastic resin film may be produced by an extrusion method or similar conventional method. Regarding a material, use may be made of a resin based on polyester (preferably copolymerized polyester), nylon (preferably copolymerized nylon), polyolefin, polystyrene, vinyl chloride, acrylic acid derivative, ethylene, vinyl alcohol, polycarbonate copolymer, etc. Among them, resins having high perforation sensitivity are desirable. In this respect, the thermoplastic resin forming the film should lie substantially in a range of from the amorphous level to the crystallinity of 15%. More preferably, the film should be of substantially amorphous level. Here, the words "film of substantially amorphous level" refer to a film whose material has hardly any melting point when subjected to a DSC method, a film whose crystallization was suppressed by, for example, quenching or similar treatment, etc. While crystallinity can be determined by an X-ray method, it may be determined in terms of the area ratio of melting energy by the DSC method.

More preferably, the thermoplastic film should be mainly constituted by copolymerized polyester and be of substantially amorphous level. Most preferably, the copolymerized polyester, as a raw material, should be substantially amorphous. The words "substantially amorphous polyester" refers to polyester other than commercially available ordinary resins whose major component is high crystallinity polyester terephthalate having a crystal melting point (determined by the DSC method) of 245° C. to 260° C. Specifically, assume that a singular polymer, a polymer made up of a mixture of components, a mixture of polymers, or a mixture of polymers each being made up of a mixture of components is sufficiently annealed to equilibrium, and then the annealed composition has the crystallinity thereof fixed by the X-ray method. Then, taking such a sample as a standard, the substantially amorphous polyester mentioned above should have crystallinity less than 10%, preferably less than 5%; more preferably, it has hardly any melting point when subjected to the DSC method. When this kind of low crystallinity type thermoplastic film is used, it can be perforated by heat sufficiently even though the energy of a thermal head may be small.

The thermoplastic resin film should preferably be 0.5 $\mu$m to 20 $\mu$m thick, more preferably 1 $\mu$m to 10 $\mu$m thick. The fusion start temperature should be 50° C. to 300° C., preferably 70° C. to 290° C.

To prevent the film from melting and adhering to a thermal head due to heat, fatty acid metal salt, phosphor acid ester type surface active agent, silicone oil or similar fluid lubricant, or fluorin compound having a perfluoroalkyl radical or similar agent may be uniformly applied to the surface of the film that contacts the head. The amount of application of such an agent is 0.001 g/m$^2$ to 2 g/m$^2$, preferably 0.05 g/m$^2$ to 1 g/m$^2$.

To provide the thermoplastic resin film with an antistatic feature, an antistatic agent may be uniformly applied to the film or may be contained in the film. If desired, the antistatic agent may be mixed with the abovementioned anti-adhesion agent before application to the film.

The antistatic agent may be selected from a family of conventional agents including organic sulphonic acid metal salt or polyalkylene oxide, ester, amine, carbonic acid salt, quaternary ammonium salt, and alkyl phosphoric acid ester. The amount of application should be 0.001 g/m$^2$ to 2.0 g/m$^2$, preferably 0.01 g/m$^2$ to 0.5 g/m$^2$.

When the antistatic agent is to be contained in the film, use may be made of organic sulphonic acid metal salt or polyalkylene oxide, a mixture of one or more quaternary ammonium salts.

An organic sulphonic acid metal salt is a compound represented by a formula $R^1SO_3X^1$ where $R^1$ and $X^1$ are representative of an aliphatic radical, alicylic radical or aromatic radial and Na, K, Li or similar metal, respectively. Specific examples are alkyl sulphonic acid metal salt and alykybenzene sulphonic acid metal salt. In this case, alkyl may be implemented by octyl, decyl, dodecyl (lauryl), tetradecyl (myristyl), hexadecyl, or octadecyl (stearyl). More specific examples are lauryl sulphonic acid natrium, lauryl sulphonic acid kalium, lauryl sulphonic acid rithium, stearyl sulphonic acid natrium, stearyl suphonic acid kalium, stearyl sulphonic rithium, dodecylbenzene sulphonic acid natrium, dodecylbenzene sulphonic kalium, and dodecylbenzene sulphonic rithium.

On the other hand, the content of organic sulphonic acid metal salt in the thermoplastic resin film is 0.1 Wt % to 2 Wt %, preferably 0.2 Wt % to 1.5 Wt %; contents smaller than 0.1 Wt % degrade the antistatic effect while contents greater than 2 Wt % roughen the surface of the film.

Polyalkylene oxide to be contained in the film may be implemented by polyethylene oxide, polypropylene oxide, polyethylene-polypropylene oxide copolymer, or polytetramethylene oxide by way of example. The molecular weight of polyalkylene oxide is 40 to 500,000, more preferably 1,000 to 50,000. The content of polyalkylene oxide in the film is 0.1 Wt % to 5 Wt %, preferably 0.2 Wt % to 4 Wt %. Contents smaller than 1 Wt % degrade the antistatic effect while contents greater than 5 Wt % lower the dynamic energy of the film A conduction agent is also contained in the film and implemented by quaternary ammonium salt represented by a formula $[R^2—N(CH_3)_2—R^3]X^2$ where $R^2$, $R^3$ and $X^2$ are respectively representative of an alkyl radical whose carbon number is 12 to 18, an alkyl or methyl radial whose carbon number is 12 to 18, and CI or Br; or a mixture of two or more of such salts. The content of ammonium salt in the film is 1 Wt % to 50 Wt %, preferably 2 Wt % to 30 Wt %.

Figure 5:
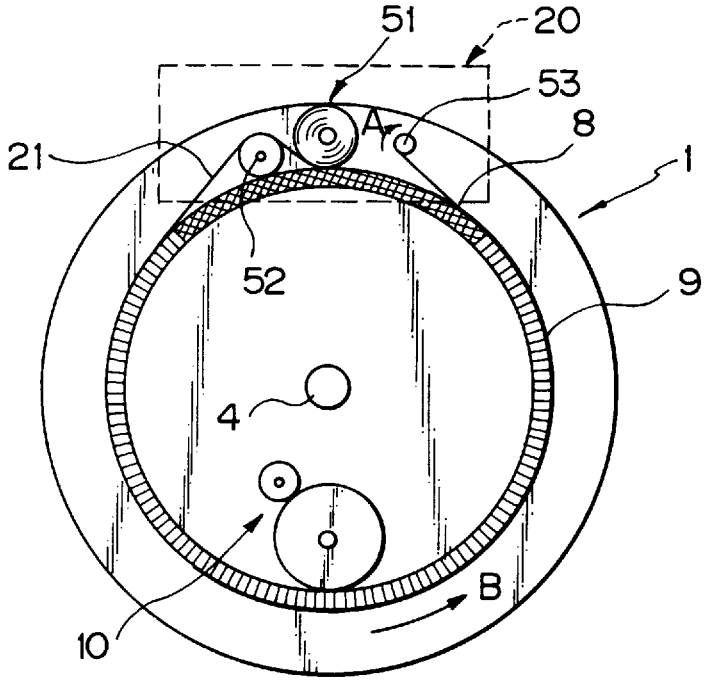
FIG. 5 is a section of a drum included in a printer having a stencil feed and discharge unit constructed integrally with the drum.
Figure 6:
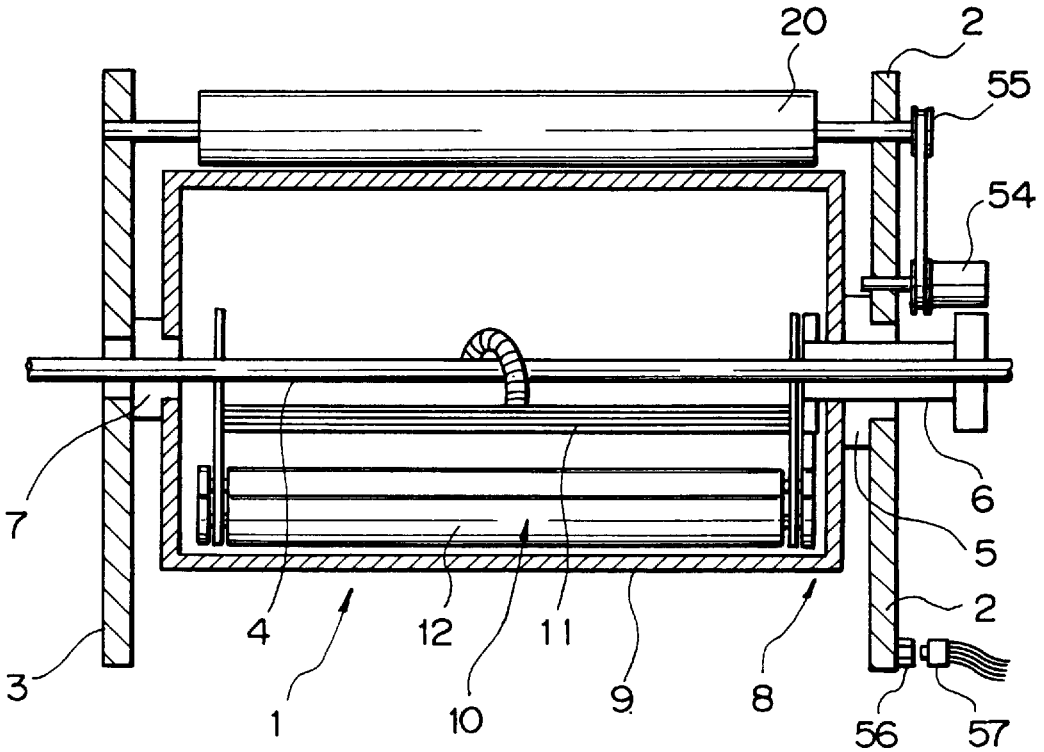
FIG. 6 is a sectional side elevation of the arrangement shown in FIG. 5.

A reference will be made to FIGS. 5 and 6 for describing a printer to which the present invention is applied. As shown, a hollow cylindrical drum 1 has a peripheral wall 8 and is provided with side plates 2 and 3 at opposite ends thereof. A stationary shaft 4 extends throughout the drum 1. The side plate 2 is supported by the shaft 4 through a clutch 5 and a drive shaft 6 extending from a motor, not shown. The other side plate 3 is supported by the shaft 4 through a clutch 7. When the clutches 5 and 7 are uncoupled, the side plates 2 and 3 and the peripheral wall 8 of the drum 1 are rotatable independently of each other. A part of the wall 8 of the drum 1 that constitutes a print surface is implemented as a portion 9 permeable to ink. An ink supply unit 10 is disposed in the drum 1 and affixed to the shaft 4. The ink supply unit 10 has an ink distributor 11 and an ink roller unit 12.

A stencil feed and discharge unit 20 is supported by the side plates 2 and 3 and located in the vicinity of the peripheral wall 8 of the drum 1 and are associated with the rotating drum 1. The stencil feed and discharge unit 20 has a feed section 51 accommodating a roll of stencil 21, a platen roller 52, and a discharge or take-up section 53 for taking up the used part of the stencil 21. The feed section 51, platen roller 52 and discharge section 53 extend in parallel with the axis of the drum 1. The platen roller 52 and discharge section 53 are rotated by a motor 54 via a pulley 55. A cable 57 is connected to a connector 56 mounted on the side plate 2 so as to feed a drive signal to the motor 54. The connection of the cable 57 to the connector 56 may be implemented by conventional mechanical or electrical means. The connector 56 may also function as means for fixing the side plate 2 in place.

Figure 7:
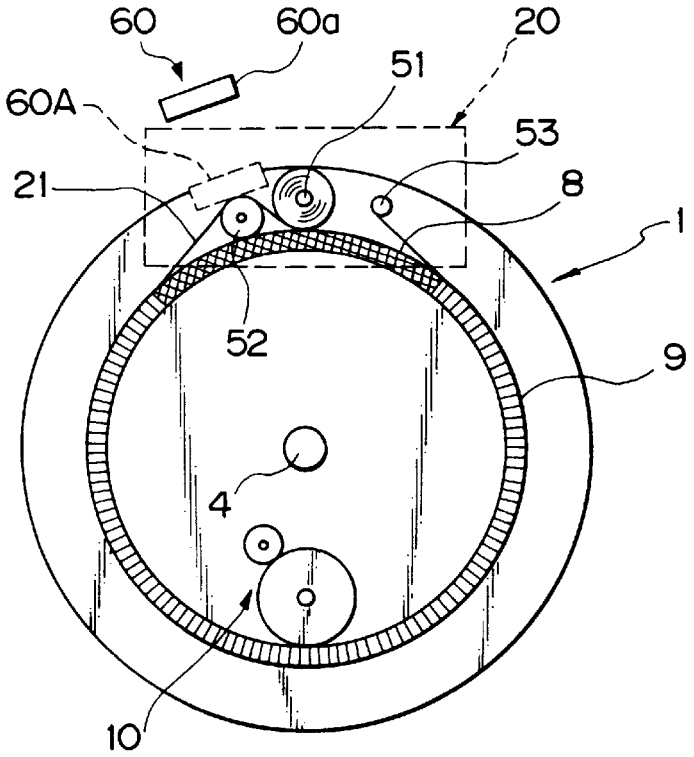
FIG. 7 is a section showing a specific arrangement wherein a master making section is located outside of the rotation system of the drum.

As shown in FIG. 7, a head unit 60 has a thermal head, or cutting means, 60*a* and is located to face the platen roller 52 at a position where it does not obstruct the rotation of the drum 1. The head 60*a* is driven by a cam, solenoid, crank or similar mechanism, not shown, to move between the position where it does not obstruct the rotation of the drum 1 (inoperative position), and a position 60A where it presses against the platen roller 52 (operative position). Only when the printer makes a master out of the stencil 21, the head 60*a* is brought into contact with the platen roller 52 with the intermediary of the stencil 21.

Figure 8:
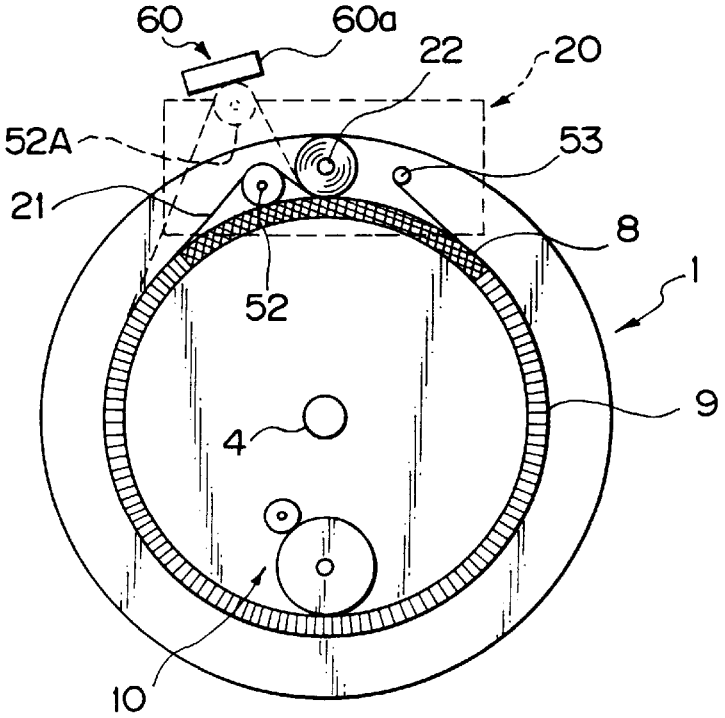
FIG. 8 is a view similar to FIG. 7, showing another specific arrangement wherein the master making section is located outside the drum.

Alternatively, as shown in FIG. 8, an arrangement may b e made such that the platen roller 52 is movable between an inoperative position inside of the rotation system of the drum 1 and an operative position 52A where it presses against the head 60*a* located outside of the rotation system. Further, both the head 60*a* and the platen roller 52 may be constructed to be movable. Specifically, it is possible to locate the head 60*a* outside the rotation system of the drum 1, move the head 60*a* between the operative position where it contacts the platen roller 52 and the inoperative position outside of the rotation system, and move the roller 52 between the operative position and the inoperative position outside of the rotation system.

Means is provided for detecting the trailing edge of the part of the stencil cut by the head 60*a*, i.e., master 21. Specifically, an end mark sensor, not shown, is implemented by conventional optical means and located at a position where it does not obstruct the rotation of the drum 1. The end mark sensing means is movable, as needed.

Figure 9A:
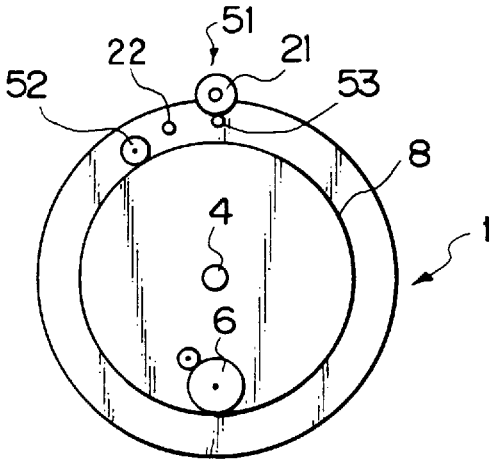
FIGS. 9A–9D demonstrate a specific procedure for wrapping a stencil around the drum in accordance with the present invention.
Figure 9B:
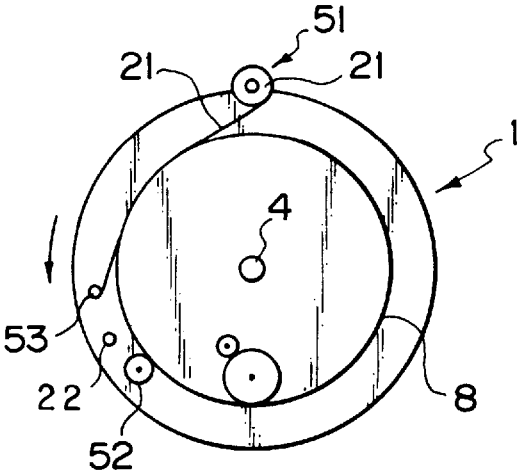
Figure 9C:
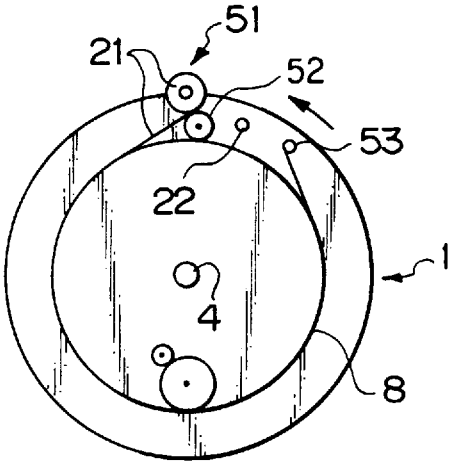
Figure 9D:
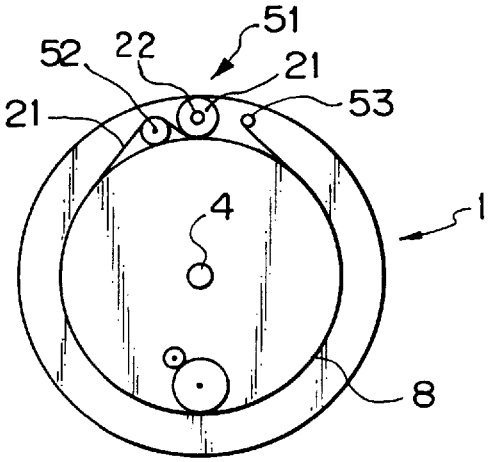

Referring to FIGS. 9A and 9D, a procedure for wrapping the cut stencil or master 21 around the drum 1 in accordance with the present invention will be described. The edge of the webbing 21 paid out from the feed section 51 is affixed to the discharge or take-up section 53, while the roll is locked in a position outside of the rotation system of the drum 1 (FIG. 9A). The roll 21 is rotatable about the axis thereof. In practice, the previously stated feed shaft 22 or the cylindrical center bore of the cassette is fixed in place at the outside of the rotation system of the drum, while the take-up shaft 23 is fixed in place in the take-up section 53. Thereafter, the support member 31, 32 or 33 is removed. In this condition, the drum 1 is driven by the drive shaft 4 to wrap the master 21 around the peripheral wall 8 of the drum 1 (FIGS. 9B and 9C). The drum 1 is rotated until the feed section 51 reaches a predetermined position adjoining the roll 21, and then the rotation is stopped. Finally, the roll 21 is unlocked and then set in the feed section 51 (FIG. 9D). By such a procedure, the master 21 is wrapped around the drum 1.

To effect the above procedure, a manual switch may be operated to control the rotation of the drum 1. Alternatively, the rotation of the drum 1 may be automatically controlled in response to information fed back from a position sensor, not shown, mounted on the drum l.

When cutting the stencil 21, the feed and discharge unit 20 are held in a predetermined position (raised position) until the stencil 21 is looped around the drum 8 and the platen passes under the stencil 8 and stops with respect to the axis of the drum 8, as shown in FIG. 9D. The platen roller 52 is moved from the inoperative position inside of the rotation system of the drum to the operative position 52A where it contacts the head 60*a* fixed in place, as shown in FIG. 8; or the thermal head 60*a* is brought to the position 60A into contact with the platen roller 52, as shown in FIG. 7; or both of them are moved into contact with each other. On the other hand, when the discharge section 53 is rotated in the direction indicated by an arrow A in FIG. 5, the wall 8 of the drum 1 is also rotated in the direction indicated by an arrow B. As a result, the master or used part of the stencil 21 is taken up by the discharge section 53. At the same time, a fresh part of the stencil 21 is paid out from the feed section 51, and the drum wall 8 is rotated. When the wall 8 in rotation reaches a predetermined position, an image signal is fed to the head 60*a*. Hence, the fresh part of the stencil 21 is sequentially wrapped around the wall 8 while being cut by the head 60*a*. When the drum 1 reaches a predetermined position, i.e., when a necessary image has been fully cut in the stencil 21, the signal to the head 60*a* disappears. Then, the head 60*a* or the platen roller 52 is retracted to the original position thereof. Subsequently, as the drum wall 8 reaches a predetermined position, the drive transmission to the wall 8 and discharge section 53 is interrupted to complete the master making operation. Thereafter, the signal cable 57 is removed from the connector 56, and then the feed and discharge unit 20 is rotated together with the drum 1 to print the image on a sheet via the master 21.

Figure 10:
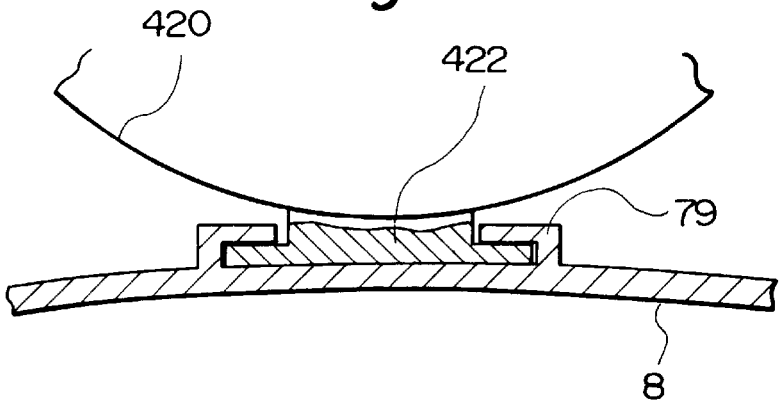
FIG. 10 is representative of another specific wrapping procedure available with the present invention.
Figure 11A:
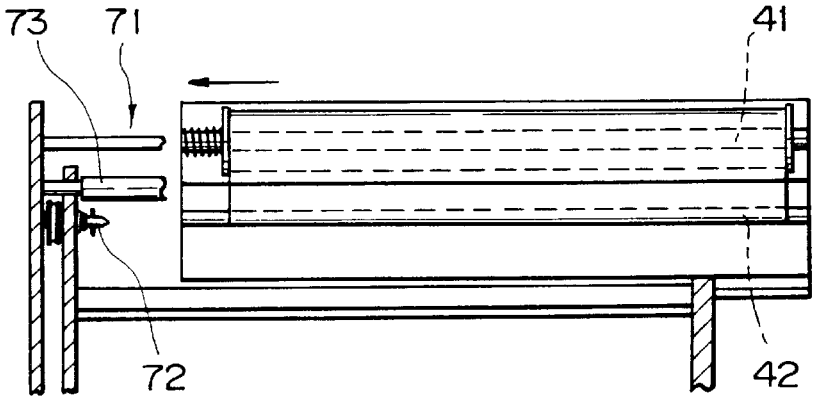
FIGS. 11A–11C show how the cassette of FIGS. 4A and 4B is mounted to the printer specifically.
Figure 11B:
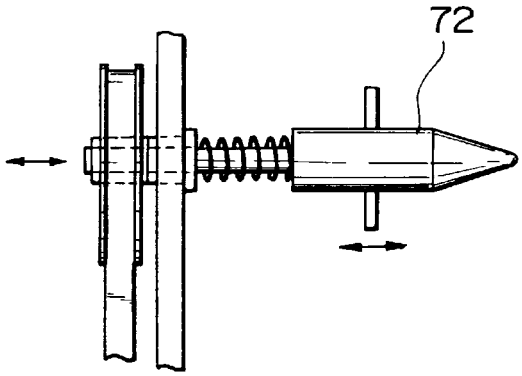
Figure 11C:
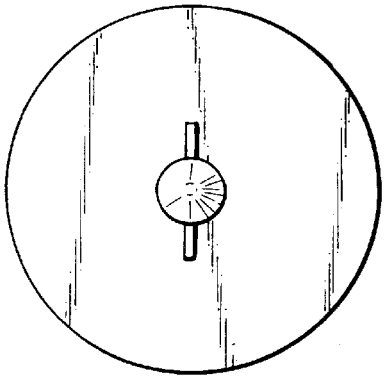

How the cassette shown in FIGS. 4A and 4B is mounted to the printer will be described with reference to FIG. 10. As shown, the engaging member 422 provided on the bottom of the take-up casing part 420 mates with a retaining lug 79 formed on the surface of the drum 8. The configuration of the member 422 and lug 79 shown in FIG. 10 is only illustrative and may be replaced with any other configuration so long as it can removably affix the casing part 420 to the surface of the drum 8. As shown in FIG. 11A, to mount the cassette to the printer, the feed shaft 41 is connected to a feed shaft 71 which is movable up and down, but not rotatable. The take-up shaft 42 is connected to a take-up shaft 72 which is rotatable with the drum 1. There is also shown in FIG. 11A a guide roller 73 for guiding the webbing 21 (see also guide roller 74 in FIGS. 12A–12E). As shown in FIGS. 11B and 11C, the configuration of the take-up shaft 72 and the configuration of one end of the take-up shaft 42 match each other. When the part of the cassette adjoining the drum 1 (casing part 420) is moved due to the rotation of the drum 1, the cassette is separated into the casing parts 410 and 420; a gap which does not obstruct the rotation of the drum 1 is formed.

Figure 12A:
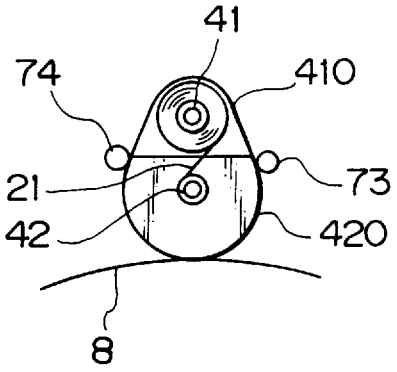
FIGS. 12A–12E show a procedure in which a stencil is paid out from the cassette of FIGS. 4A and 4B and wrapped around the drum.
Figure 12B:
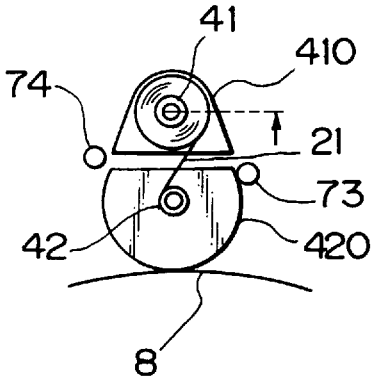
Figure 12C:
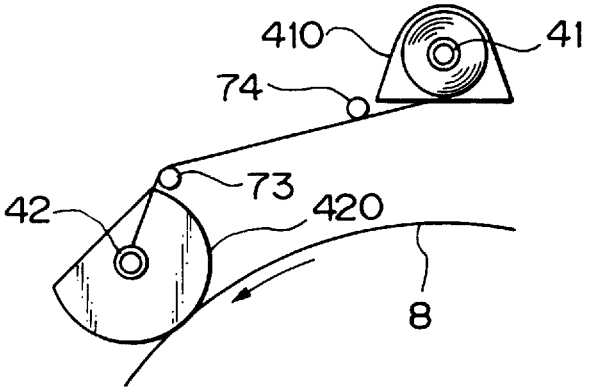
Figure 12D:
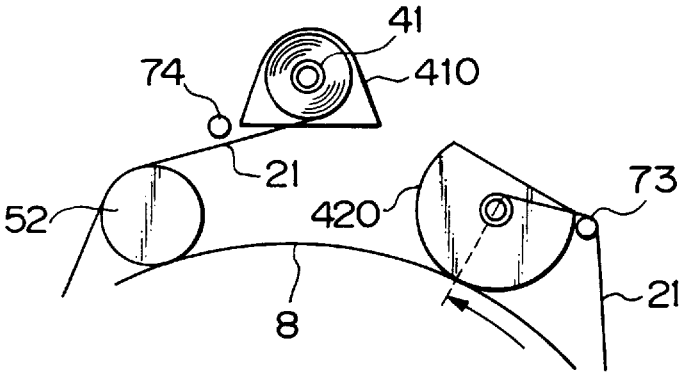
Figure 12E:
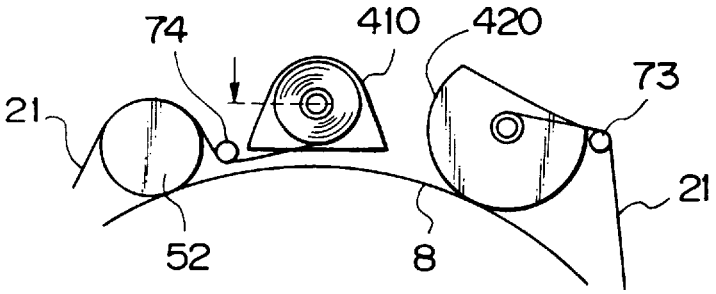

Specifically, as shown in FIG. 12A, the cassette having the engaging member 422 is set in a predetermined position on the drum 1. Then, the casing part 410 accommodating the feed shaft 41 is separated from the casing part 420 upwardly away from the drum wall 8 and then fixed in place (FIG. 12B). The casing part 420 accommodating the take-up shaft 42 is affixed to the drum 1. While this part 420 of the cassette is rotated together with the drum 1 in a direction indicated by an arrow, the webbing 21 is sequentially paid out from the feed shaft 41 (FIG. 12C). After the drum 1 has rotated substantially one rotation (FIG. 12D), the casing part 410 is moved toward the drum (FIG. 12E). Consequently, the stencil or master 21 is wrapped around the drum.

The casing parts 410 and 420 should preferably be provided with a reconnectable structure to facilitate the collection of the used webbing 21. For this purpose, the connecting portions of the casing parts 410 and 420 may be bonded together by a weak paste having such a capability or may be coupled together by structural members. If the weak paste is not sufficient alone from the handling standpoint, it may be reinforced by a removable sheet up to the time when the cassette is to be mounted to the printer. This kind of sheet may be constituted by a label indicating, for example, the kind of the stencil contained therein. This eliminates the need for an extra label and, therefore, reduces the cost.

When the cassette of FIGS. 4A and 4B is used, the head 60*a* is urged against the platen roller 52. The head 60*a* cuts the stencil 21 while the drum wall 8 is rotated, i.e., while the drum wall 8 is rotated relative to feed shaft 41, take-up shaft 42, head 60*a* and platen roller 52. The take-up shaft 42 is driven by a motor, not shown, to take up the webbing 21 at the same speed as the peripheral speed of the drum wall 8. A mechanism for determining the amount of webbing 21 remaining in the cassette is provided and preferably implemented as an end mark sensing mechanism. As this mechanism determines that the webbing 21 is short, a further master making operation is inhibited. In this condition, the webbing 21 or, in the event of replacement, the remaining webbing 21 and master are fully taken up by the shaft 42. At this instant, the drum wall 8 is, of course, rotated at the same peripheral speed as the webbing transport speed. After the entire webbing 21 has been taken up by the shaft 42, the casing part 410 with the feed shaft 41 is retracted to the position shown in FIG. 12D. Then, the casing part 420 with the take-up shaft 42 is brought to the position shown in FIG. 12B. In this condition, the two casing parts 410 and 420 are again coupled together. The used cassette, i.e., the coupled casing parts 410 and 420 are taken out from the printer and replaced with a new cassette.

The webbing 21 applicable to this kind of cassette is constituted by a thermoplastic resin film which contains coplymerized polyester as a major component and is about 6.3 $\mu$m thick and substantially amorphous (crystallinity of 1%). The surface of the film that contacts the head 60*a* is coated with a fusion preventing agent implemented by acryl silicon (US-270 available from Toa Synthetic Chemicals (Japan)), and an antistatic agent implemented by quaternary ammonium salt dodecyltrimethyl ammonium chloride ($C_{12}H_{25}N(CH_3)_2CH_3Cl$). These two agents are in a ratio of 1:1 and 0.1 g/m$^2$ heavy when dried. Such a webbing 21 is rolled up and installed in the cassette shown in FIG. 4A and 4B. The casings 410 and 420 are made of acryl. This kind of webbing 21 is also applicable to any one of the cassettes shown in FIGS. 1A and 1B, 2A and 2B, and 3A and 3B.

In summary, it will be seen that the present invention has various unprecedented advantages, as enumerated below.

(1) Since a stencil feed and discharge unit and a drum are constructed integrally with each other, a stencil can be fed, cut, wrapped around the drum, and then discharged without being cut off.

(2) Even a stencil substantially implemented by a thermoplastic resin film, which is thin and soft, can be transported without being creased or otherwise deformed.

(3) The stencil substantially implemented by a thermoplastic resin film can be rolled up to a small diameter and, therefore, reduces the size of the feed and discharge unit.

(4) Since a thermal head is located outside of the feed and discharge unit and, in addition, outside of the rotation system of the drum, the feed and discharge unit is light weight and rotatable smoothly. Moreover, the wiring to the head is simple, and paper dust and other impurities, which would obstruct stencil cutting, are prevented from depositing on the head.

(5) The part of the stencil cut by the head, i.e., master can be automatically wrapped around the drum.

(6) Since the stencil is accommodated in a cassette, it can be set on the drum and cut easily.

Various modifications will become possible for those skilled in the art after receiving the teachings of the present disclosure without departing from the scope thereof.

What is claimed is:

1. A printer using a stencil, comprising:

a drum having a drum axis and a portion permeable to ink in a part of a peripheral wall thereof and allowing a cut portion of the stencil to be wrapped therearound;

means for rotating said drum about the drum axis;

ink supplying means disposed internally of said peripheral wall of the drum;

a stencil feed and discharge unit adjoining an outer periphery of said peripheral wall of said drum, said stencil feed and discharge unit comprising at least a feed section accommodating the stencil in the form of a roll, a discharge section for taking up and accommodating said used stencil, and a platen roller for use in cutting said stencil;

means for rotating at least one of said feed section and said discharge section about the drum axis along said outer periphery of said peripheral wall of said drum; and cutting means located externally of the peripheral wall of the drum and being positioned stationary away from said drum during wrapping of the stencil about the drum, and pressing, in the event of making a master, against said platen roller to image the stencil by heat cutting.

2. A printer as claimed in claim 1, further comprising means for moving said cutting means relative to said platen roller, between an operative position for pressing against said platen roller and an inoperative position located away from said drum.

3. A printer as claimed in claim 1, further comprising means for moving said platen roller relative to said cutting means, between an operative position for pressing against said cutting means and an inoperative position located adjacent said drum.

4. A printer as claimed in claim 1, wherein the stencil feed and discharge unit positions the stencil with an edge paid out from said roll, and wrapped around said drum, such that said edge and said roll meet each other when said edge is wrapped around said drum.

5. A printer as claimed in claim 1, further comprising: a cassette for containing said stencil and comprising a take-up shaft and a removable support member supporting said take-up shaft, such that an edge of said stencil paid out from the roll is taken-up by said take-up shaft, said cassette removable from said drum.

6. A printer as claimed in claim 5, wherein said cassette is mounted to said feed section, has said take-up shaft connected to said discharge section, said support member being removed to allow said stencil to be paid out, the stencil being wrapped around said drum while being cut and said edge and said roll meeting each other when said edge is wrapped around said drum.

7. A printer as claimed in claim 1, further comprising: a cassette for containing said stencil and having a feed shaft, a take-up shaft, and a separable support member supporting said feed shaft and said take-up shaft, such that an end of said stencil paid out from the roll is taken up by said take-up shaft.

8. A printer as claimed in claim 7, wherein said cassette is mounted to said feed section, said take-up shaft connected to said discharge section, and said separable support member separated into two, the stencil is wrapped around said drum while being cut with the two separated parts of said support member moved relative to and away from each other.

9. A printer using a stencil, comprising:

a drum having a longitudinal drum axle and a peripheral wall forming a cylinder defining an interior and exterior of the drum;

means for rotating the drum about the longitudinal drum axle;

ink supply means positioned within the interior of the drum for supplying ink to the peripheral wall;

a permeable portion of said drum for allowing ink from the ink supply means to permeate through the drum and form on the exterior of the drum;

a side plate positioned at the end of said drum, forming a plane being perpendicular to said longitudinal drum axle;

a feed section rotatable about a discharge axle, and having a stencil material rolled about said discharge axle;

clutch means connected to said side plate and said drum for locking said side plate and said drum from rotating with respect to each other, and for unlocking said drum and said side plate to allow said side plate to rotate about said drum;

a discharge section having a take-up axle, the take-up axle being attached to an end of said stencil material for taking up said stencil material paid out by said feed section, said discharge section rotating about said take-up axle;

means for fixing the take-up axle with respect to the drum;

a platen roller; and wherein, during wrapping of said stencil material about said drum in preparation for imaging, said feed section is positioned away from said drum, said clutch locks said drum to said plate, said discharge section, said platen roller and said drum rotate together and freely about said longitudinal drum axle with respect to said feed unit, said discharge section draws out said stencil material and deposits said stencil material directly on said peripheral wall and over said permeable portion as said drum rotates until said platen roller passes under said feed section.

10. The apparatus according to claim 9, further comprising:

a cutting means;

means for moving the cutting means from a non-imaging position away from the drum to an imaging position engaged with said platen roller;

said platen roller being fixed with respect to said drum;

wherein, during imaging of said stencil material, said clutch unlocks said side plate with respect to said drum, said feed section moves toward said peripheral wall and causes said platen roller to be sandwiched between said stencil material and said peripheral wall, said cutting means is movably engaged with said stencil material from said non-imaging position to said imaging position in contact with said platen roller, and said cutting means forms a stenciled pattern on said stencil material as said drum rotates.

11. The apparatus according to claim 9, further comprising:

cutting means;

means for attaching said platen roller to said drum and for moving the platen roller from a non-imaging position adjacent said peripheral wall of said drum to an imaging position away from said peripheral wall;

wherein, during imaging of said stencil material, said clutch unlocks said side plate with respect to said drum, said platen roller is moved from said non-imaging position to said imaging position causing said stencil material to be in contact with said cutting means, and said cutting means forms a stenciled pattern on said stencil material as said drum rotates.

12. A printer using a stencil, comprising:

a drum having a drum axis and a portion permeable to ink in a part of a peripheral wall thereof and allowing a cut portion of the stencil to be wrapped therearound;

means for rotating said drum about the drum axis;

ink supplying means disposed internally of said peripheral wall of the drum;

a stencil feed and discharge unit adjoining an outer periphery of said peripheral wall of said drum, said stencil feed and discharge unit comprising at least a feed section accommodating the stencil in the form of a roll, a discharge section for taking up and accommodating said used stencil, and a platen roller for use in cutting said stencil;

means for rotating at least one of said feed section and said discharge section about the drum axis along said outer periphery of said peripheral wall of said drum;

cutting means located externally of the peripheral wall of the drum and being positioned stationary away from said drum during wrapping of the stencil about the drum and pressing, in an event of making a master, against said platen roller to image the stencil by heat cutting; and a cassette for containing said stencil and comprising a take-up shaft and a removable support member supporting said take-up shaft, such that an edge of said stencil paid out from the roll is taken-up by said take-up shaft, said cassette being removable from said drum, wherein said cassette is mounted to said feed section, said take-up shaft is connected to said discharge section, said support member being removed to allow said stencil to be paid out, the stencil being wrapped around said drum while being cut and said edge and said roll meeting each other when said edge is wrapped around said drum.

13. A printer using a stencil, comprising:

a drum having a drum axis and a portion permeable to ink in a part of a peripheral wall thereof and allowing a cut portion of the stencil to be wrapped therearound;

means for rotating said drum about the drum axis;

ink supplying means disposed internally of said peripheral wall of the drum;

a stencil feed and discharge unit adjoining an outer periphery of said peripheral wall of said drum, said stencil feed and discharge unit comprising at least a feed section accommodating the stencil in the form of a roll, a discharge section for taking up and accommodating said used stencil, and a platen roller for use in cutting said stencil;

means for rotating at least one of said feed section and said discharge section about the drum axis along said outer periphery of said peripheral wall of said drum;

cutting means located externally of the peripheral wall of the drum and being positioned stationary away from said drum during wrapping of the stencil about the drum, and pressing, in an event of making a master, against said platen roller to image the stencil by heat cutting; and a cassette for containing said stencil and having a feed shaft, a take-up shaft, and a separable support member supporting said feed shaft and said take-up shaft, such that an end of said stencil paid out from the roll is taken up by said take-up shaft, wherein said cassette is mounted to said feed section, said take-up shaft is connected to said discharge section, and said separable support member is separated into two, the stencil being wrapped around said drum while being cut with the two separated parts of said support member moved relative to and away from each other.

14. A method of mounting a cassette containing a stencil, a first casing part including a stencil feed shaft and a second casing part including a stencil take-up shaft onto a drum, comprising the steps of:

separating the first casing part from the second casing part;

fixing in place the first casing part;

rotating the second casing part with a rotation of the drum to wrap the stencil around the drum.

15. The method of claim 14, further comprising the step moving the first casing part toward the drum after the second casing part and drum have rotated substantially one rotation.

* * * * *